US006341975B1

(12) United States Patent
Takatsuki et al.

(10) Patent No.: US 6,341,975 B1
(45) Date of Patent: Jan. 29, 2002

(54) CONNECTOR WITH LOCKING ARM HAVING GROOVE FACING AWAY FROM CONNECTOR HOUSING

(75) Inventors: Kozue Takatsuki; Masahiko Aoyama; Masahide Hio, all of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/639,526

(22) Filed: Aug. 16, 2000

(30) Foreign Application Priority Data

Aug. 25, 1999 (JP) ..... 11-238763

(51) Int. Cl.[7] ..... H01R 13/627
(52) U.S. Cl. ..... 439/358
(58) Field of Search ..... 439/358, 350, 439/357, 488, 352, 489, 752, 923, 701, 712, 372

(56) References Cited

U.S. PATENT DOCUMENTS

| | | | | | |
|---|---|---|---|---|---|
| 5,643,003 | A | * | 7/1997 | Myer et al. | 439/352 |
| 5,667,403 | A | * | 9/1997 | Fukuda et al. | 439/489 |
| 5,711,684 | A | * | 1/1998 | Inoue et al. | 439/354 |
| 5,775,932 | A | * | 7/1998 | Saito et al. | 439/378 |
| 5,934,944 | A | * | 8/1999 | Aoyama et al. | 439/701 |
| 6,022,238 | A | * | 2/2000 | Tomita et al. | 439/352 |
| 6,116,939 | A | * | 9/2000 | Fukuda | 439/354 |
| 6,129,574 | A | * | 10/2000 | Okayasu et al. | 439/404 |
| 6,129,593 | A | * | 10/2000 | Aoyama et al. | 439/701 |

FOREIGN PATENT DOCUMENTS

| | | |
|---|---|---|
| JP | 1-112577 | 7/1989 |

* cited by examiner

*Primary Examiner*—Gary Paumen
*Assistant Examiner*—Phuong Nguyen
(74) *Attorney, Agent, or Firm*—Anthony J. Casella; Gerald E. Hespos

(57) ABSTRACT

A connector (A) includes a connector housing (10) with a locking arm (11) extending from an outer surface (10A) of the connector housing (10). A groove (16) is formed on a base part (12) of the locking arm (11) along a direction in which the base part (12) is erected. A groove (18) is formed on an arm part (13) of the locking arm (11) along a direction in which the arm part (13) extends. A thickness Tk between a bottom surface (16A) of the groove (16) of the base part (12) and a rear surface (12R) thereof is set larger than a vertical thickness Ta of the arm part (13). When the locking arm tilts in a direction in which the locking arm (11) moves away from the connector housing (10), with the base part (12) acting as the supporting point of the tilting motion of the locking arm (11), a rib-shaped portion (16B) at both sides of the groove (16) makes the base part (12) less flexible than the arm part (13). Thus, the degree of the strain of the base part (12) is low. On the other hand, the formation of the groove (18) allows the arm part (13) to be more flexible than the base part (12). The deformation of the arm part (13) relaxes a tilting force that is applied to the base part (12). Accordingly, it is possible to prevent the locking arm (11) from being broken at its base part (12).

15 Claims, 4 Drawing Sheets

CONNECTOR WITH LOCKING ARM HAVING GROOVE FACING AWAY FROM CONNECTOR HOUSING

BACKGROUND OF THE INVENTION

1. Field of the Invention

The present invention relates to a connector having a locking arm.

2. Description of the Related Art

A connector with a locking arm is disclosed in Japanese Patent Application Laid-Open No. 1-112577. This prior art connector includes a connector housing, and the locking arm is formed integrally with an outer surface of the connector housing. The locking arm includes a base part erected from the outer surface of the connector housing. An arm part cantilevered is from the base part and extends along the outer surface of the connector housing. A locking projection is formed on the outer surface of the arm part, which is the surface facing away from the outer surface of the connector housing. The connector and a mating connector are connectable with each other. During this connection, the locking projection interferes with the hood of the mating connector. As a result, the locking arm flexes elastically toward the outer surface of the connector housing. When both connectors are placed in the normal fit-in state, the locking arm is restored elastically to its original state, and the locking projection is locked in the locking hole of the hood. As a result, both connectors are locked to each other in the normal fit-in state.

Prior art connectors have a connector housing that accommodates metal terminal fittings. The metal terminal fittings are fixed to ends of electric wires, and several such wire/connector housing assemblies are combined with each other to produce a wire harness subassembly. Wire harness subassemblies are packed in a shipping case for transport by piling them up one upon another.

The prior art connector with a locking arm also includes a flexure space between the locking arm and the outer surface of the connector housing. The locking arm is cantilevered and extended over the connector housing. Thus, there is a possibility that a foreign matter may penetrate into the flexure space between the locking arm and the outer surface of the connector housing.

The prior art wire harness subassemblies are taken out from the shipping case one by one in a place where they are assembled with other wires and connector housings to produce the wire harness. However, an electric wire of another wire harness subassembly that is still in the shipping case may penetrate into the flexure space and may be caught by the locking arm. If the wire harness subassembly is taken out forcibly from the shipping case in this state, the locking arm of the connector caught by the electric wire is subjected to a force for displacing the locking arm away from the outer surface of the connector housing, with the locking arm tilting on the base part acting as the supporting point.

In this event, there is a possibility that the locking arm of the conventional connector may be broken at its base part even though the displacement amount of the locking arm is not very great.

The present invention has been made in view of the above-described situation, and an object of the present invention is to prevent breakage of a locking arm displaced away from a connector housing.

SUMMARY OF THE INVENTION

The present invention is directed to a connector having a connector housing and a locking arm formed integrally with an outer surface of the connector housing. The locking arm includes a base part erected from the outer surface of the connector housing. An arm part is cantilevered from the base part and extends almost parallel with the outer surface of the connector housing. Thus a flexure space is defined between the outer surface of the connector housing and an inner surface of the arm part. The flexure space enables the arm part to flex elastically when the connector and a mating connector are locked to each other. In this construction, a groove is formed on the base part and the arm part, such that the groove formed on the base part extends along a direction in which the base part is erected and the groove formed on the arm part extends along a direction in which the arm part is extended. A thickness between a bottom surface of a groove of the base part and a surface thereof opposite to the bottom surface is almost equal to or larger than a thickness of the arm part.

Preferably, the groove of the base part is formed on a surface that receives a compression load when the locking arm is displaced in a direction away from an outer surface of the connector housing.

Preferably, a substantially cylindrically generated arc-shaped surface is defined on a surface of the base part that is continuous both with an inner surface of the arm part and with the outer surface of the connector housing.

As noted above, the prior art locking arm often is broken at its base part when the locking arm tilts away from the outer surface of the connector housing. It is believed that this breakage may occur because the base part has a great increase in the rate of strain relative to change in the tilting angle of the rear end portion of the arm part because the locking arm tilts from the connector housing, with the base part acting as the supporting point of the tilting motion of the locking arm.

According to the present invention, the groove is formed on both the base part and the arm part, and the thickness between a bottom surface of the groove of the base part and the rear surface thereof is almost equal to or larger than the thickness of the arm part. Thus, a portion at both sides of the groove in the base part projects in the shape of a rib. Accordingly, the base part is less flexible than the arm part and thus increase of the strain of the base part is suppressed. On the other hand, the formation of the groove allows the arm part to be more flexible than the base part. Consequently, the deformation of the arm part relaxes the tilting force applied to the base part.

When a tensile load is applied to the rib-shaped portion at both sides of the groove, a stress concentrates on one point and thus the outer surface of the rib-shaped portion is liable to crack and break. But, according to the first embodiment, a compression load is applied to the rib-shaped portion. Consequently, the stress is applied widely to the locking arm. Therefore, there is no fear that the locking arm is broken.

The rear surface of the base part that is continuous with the inner surface of the arm part and with the outer surface of the connector housing defines a generally cylindrical arc-shaped surface. Thus, the rear surface of the base part has a larger radius of curvature than a surface formed by a combination of a curved surface and a flat surface. Thus, a concentration of the stress on the rear surface of the base part is prevented, which allows the base part to have a higher breakage prevention function.

DETAILED DESCRIPTION OF THE PREFERRED EMBODIMENTS

A connector according to a first embodiment of the present invention will be described below with reference to FIGS. 1–6.

Figure 1:
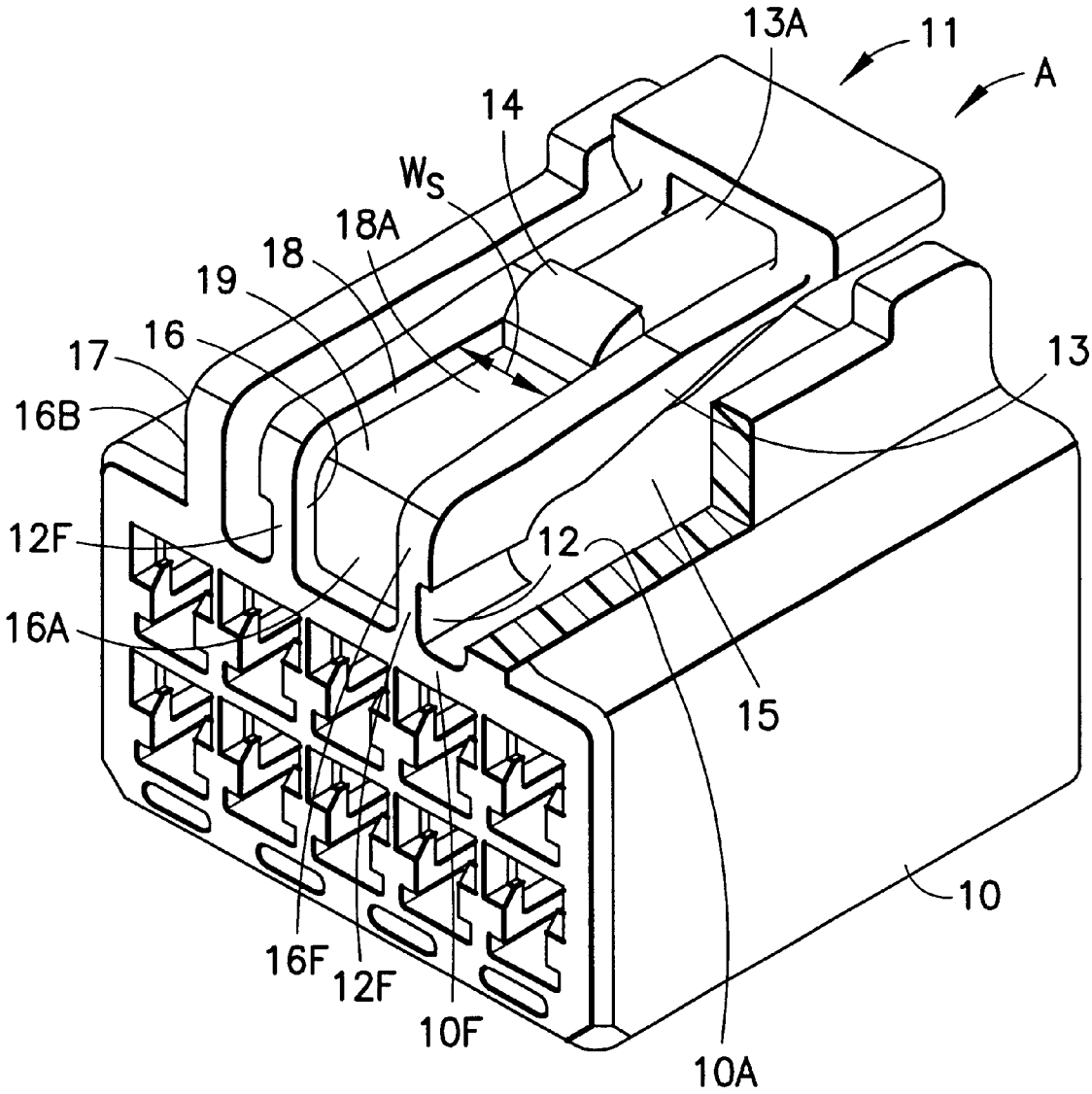
FIG. 1 is a perspective view showing a connector of a first embodiment of the present invention.
Figure 2:
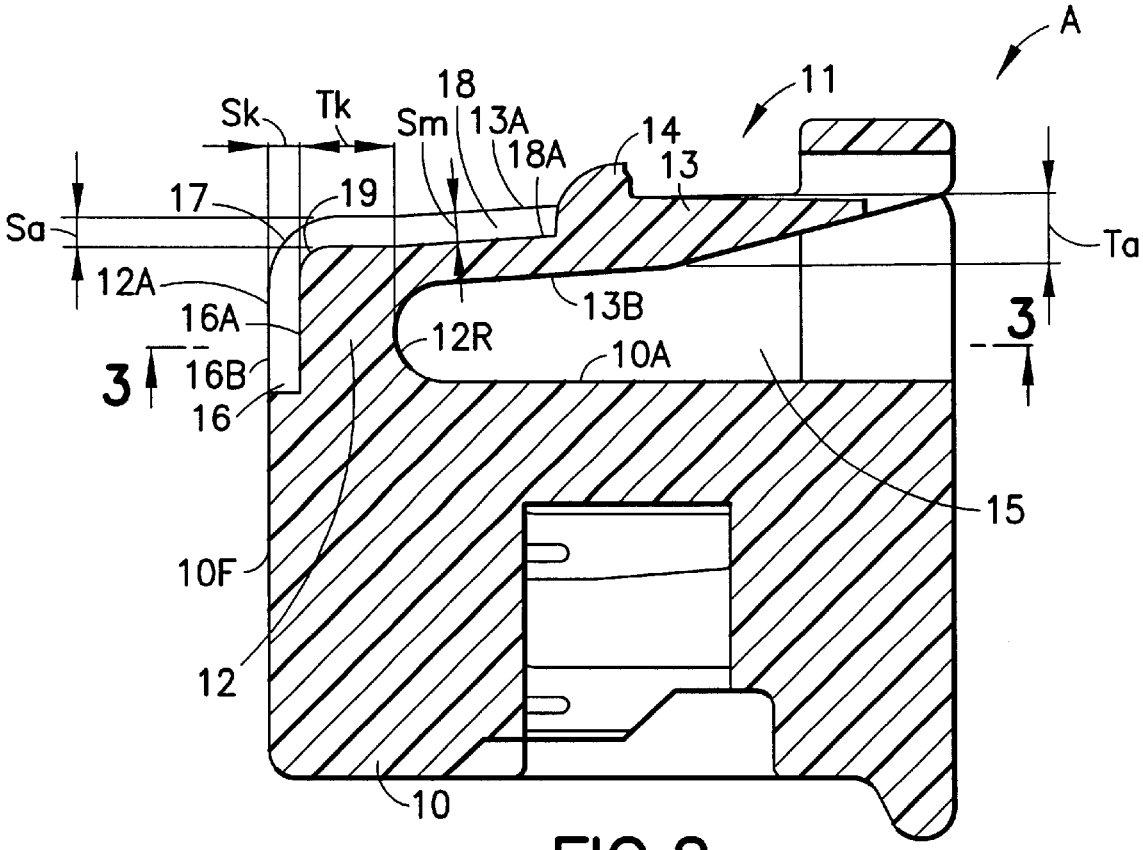
FIG. 2 is a longitudinal sectional view showing the connector.
Figure 3:
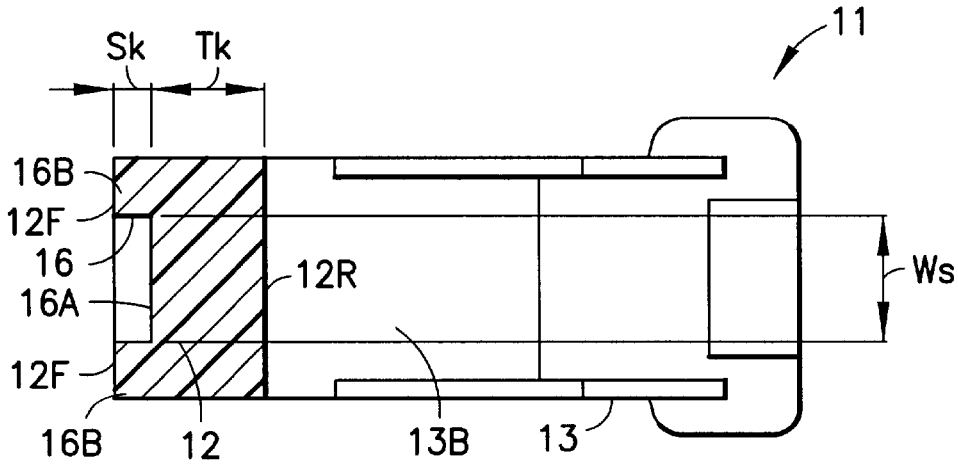
FIG. 3 is a sectional view taken along a line 3—3 of FIG. 2.
Figure 4:
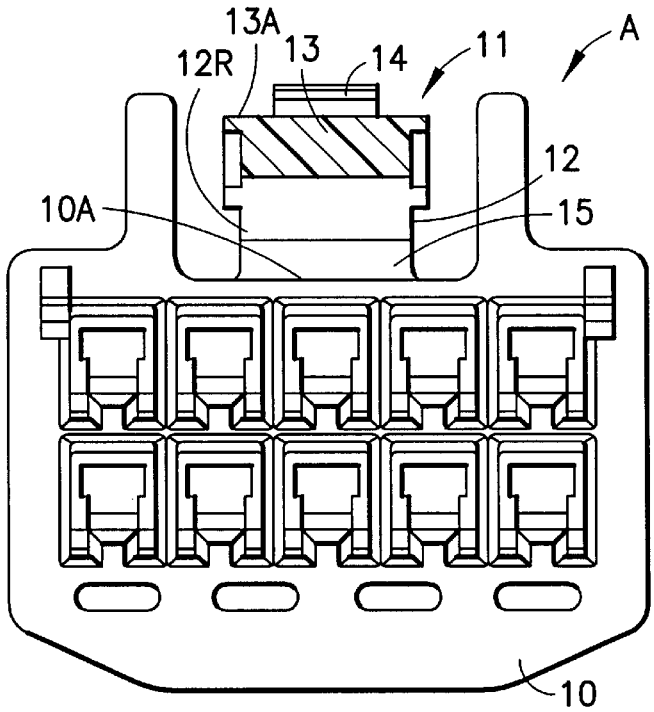
FIG. 4 is a rear view showing the connector in a state in which a locking arm is broken away.
Figure 5:
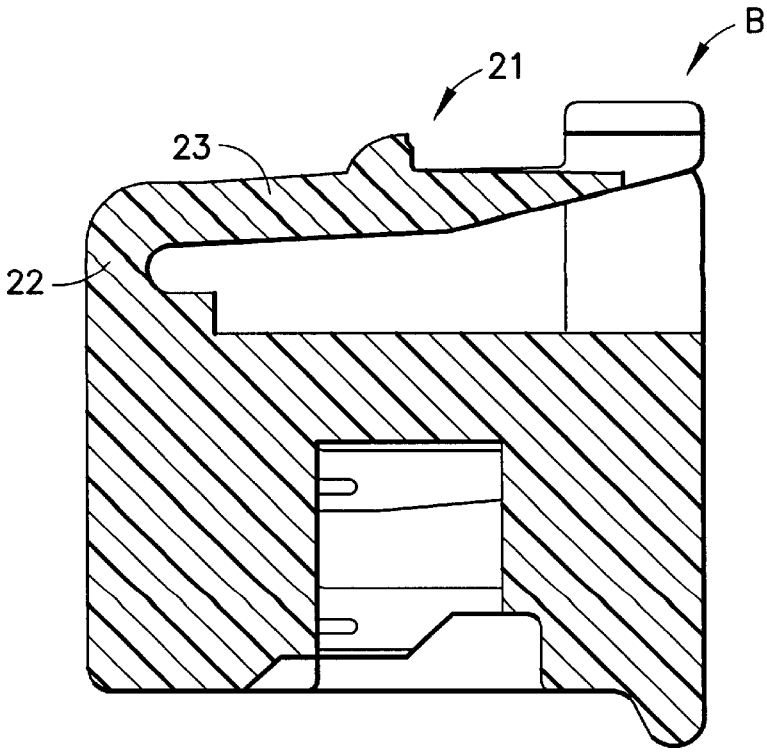
FIG. 5 is a sectional view showing a conventional connector.

A connector in accordance with a first embodiment is identified by the letter A in FIGS. 1, 2 and 4. The connector A includes a connector housing 10 made of PBT. A locking arm 11 is formed integrally with an outer surface of the connector housing 10. The locking arm 11 includes a base part 12 erected from a front end of an outer surface 10A of the connector housing 10. An arm part 13 is cantilevered from the upper end of the base part 12 and extends rearwardly along the outer surface 10A of the connector housing 10. A locking projection 14 is formed on an outer surface 13A of the arm part, which is the surface confronting the outer surface 10A of the connector housing 10. A flexure space 15 is provided between an inner surface 13B of the arm part 13 and the outer surface 10A of the connector housing 10.

The connector A and a mating connector (not shown) can be connected with each other. During this connection, the locking projection 14 interferes with an inner peripheral surface of a hood of the mating connector. As a result, the locking arm 11 flexes elastically, such that the arm part 13 tilts on the base part 12, which acts as the supporting point of the tilting motion of the arm part 13. Thus, the arm part 13 approaches the outer surface 10A of the connector housing 10. When both connectors are placed in a normal fit-in state, the locking arm 11 is restored elastically to its original state, and the locking projection 14 is locked to a locking hole (not shown) of the hood part. As a result, both connectors are locked to each other in the normal fit-in state.

The connector A of the first embodiment is used with metal terminal fittings (not shown) that have been fixed to ends of electric wires (not shown). The terminal fittings then are inserted into the rear of the connector housing 10. The connector A is combined with other connectors and wires to produce a wire harness subassembly. Then, several such wire harness subassemblies are packed in a shipping case for transport. In a wire harness-assembling place, the connector A installed on one wire harness subassembly is taken out from the shipping case. At this time, there is a possibility that an electric wire of another wire harness subassembly will penetrate into the flexure space 15 provided between the connector housing 10 and the locking arm 11 and will be caught by the arm part 13. If the wire harness subassembly is to be forcibly taken out from the shipping case in this state, the locking arm 11 caught by the electric wire is subjected to a force that will displace the locking arm 11 in a direction away from the outer surface 10A of the connector housing 10. More particularly, the locking arm 11 will tilt upward on the base part 12, with the base part 12 acting as the supporting point. In this event, there is a possibility that the locking arm of the conventional connector will be broken at its base part even though the displacement amount of the locking arm is not very great. However, the connector of the first embodiment is constructed so that the locking arm 11 can be prevented from being broken easily. The construction of the locking arm 11 will be described in detail below.

A vertical groove 16 is formed on the front surface 12F of the base part 12 of the locking arm 11, such that the groove 16 extends along the direction in which the base part 12 is erected from the connector housing 10. The front surface 12F on which the groove 16 is formed faces a direction opposite to the extension direction of the arm part 13, and receives a compression load when the locking arm 11 tilts upward, namely, in a direction away from the connector housing 10. The groove 16 is of substantially rectangular cross section, and is positioned in the center of the base part 12 in its widthwise direction. Rib-shaped portions 16B of substantially rectangular cross section are formed, respectively, at the right and left sides of the groove 16, such that the ribs 16B project forward from a bottom surface 16A of the groove 16. The base (lower end in FIG. 2) of the front surface 12F (outer surface) of the rib-shaped portion is continuous with and flush with the front surface 10F of the connector housing 10. The rise end (upper end in FIG. 2) of the front surface 12F of the rib-shaped portion 16B is continuous with the outer surface 13A of the arm part 13 through a cylindrically generated arc-shaped surface 17. Additionally, the front surface 12F of the base part 12 is almost perpendicular to the outer surface 13A of the arm part 13.

A smallest longitudinal thickness between the bottom surface 16A of the groove 16 of the base part 12 and the rear surface 12R is identified by Tk in FIG. 2. Similarly, a vertical thickness of a front region of the arm part 13, between the base part 12 and the locking projection 14, is identified by Ta in FIG. 2. The dimensions Tk and Ta are set such that the thickness Tk is about 1.5 times as large as the thickness Ta. The depth Sk of the groove 16 is set to about ⅓ of a minimum thickness Tk between the bottom surface 16A of the groove 16 and the rear surface 12R of the base part 12. Accordingly, the entire minimum thickness Tk+Sk of the entire base part 12 is about twice as large as the vertical thickness Ta of the arm part 13.

The rear surface of the base part 12 is continuous with the inner surface of 13B of the arm part 13 and with the outer surface 10A of the connector housing 10, and is formed as a substantially cylindrical generated arc-shaped surface 12R having a uniform curvature. More specifically, the arc-shaped surface 12R is a semicylindrical arc-shaped surface that is continuous with and substantially tangent to the inner surface 13B of the arm part 13. Additionally, the semicylindrical arc-shaped surface 12R is continuous with and substantially tangent to the outer surface 10A of the connector housing 10. The semicylindrical arc-shaped surface 12R substantially prevents tensile forces from being convergently applied to the rear of the base part 12 and enables an efficient dispersion of tensile forces in response to a lifting of the arm part 13. The shortest thickness Tk of the base part 12 is the thickness between its front surface 12F and a straight line parallel to the front surface 12F and tangent to the cylindrically generated arc-shaped surface 12R.

A groove 18 is formed on the outer surface 13A of the arm part 13, which is the surface of the arm part 13 that does not face the connector housing 10, and which defines the upper side of the arm part 13 in FIG. 2.

More particularly, the groove 18 extends along the extension direction (front-to-back direction) of the arm part 13.

The groove 18 is of substantially rectangular cross section, and is formed in a region of the outer surface 13A of the arm part 13 that extends substantially from the base part 12 to the locking projection 14. Thus, the groove 18 is located in the center of the arm part 13 in its widthwise direction. The front end of a bottom surface 18A of the groove 18 (upper surface in FIG. 2) is continuous with the bottom surface 16A of the groove 16 of the base part 12, with a cylindrically generated arc-shaped surface 19 extending between the surfaces 18A and 16A. Additionally, the bottom surface 18A is almost perpendicular to the bottom surface 16A. Thus the inner side surface of the groove 16 and that of the groove 18 are flush and continuous with each other. The depth Sa of the groove 18 is about ½ of the thickness Ta of the arm part 13 and almost equal to the depth Sk of the groove 16 of the base part 12. Furthermore, the groove 16 and the groove 18 have the same width Ws.

The operation of the first embodiment is described below.

As explained above, there is a potential for the locking arm 11 to be broken at its base part 12 when the locking arm 11 is subjected to a force for displacing the locking arm 11 upward from the connector housing 10, such that the locking arm 11 tilts on the base part 12, and with the base part 12 acting as the supporting point of the tilting motion of the locking arm 11. It is believed that such a breakage may occur because the base part 12 has a great increase in the rate of strain relative to change in the tilting angle of the arm part 13.

According to the first embodiment, the groove 16 is formed on the base part 12 to project the rib-shaped portion 16B forwardly from the bottom surface 16A of the groove 16. Further, the groove 18 is formed on the arm part 13. Furthermore, the smallest thickness Tk between the bottom surface 16A of the groove 16 of the base part 12 and the rear cylindrically generated arc-shaped surface 12R is larger than the vertical thickness Ta of the arm part 13.

From the viewpoint of the strength of materials, an object is less flexible if the moment of inertia of the section is greater. In the first embodiment, the thickness Tk between the bottom surface 16A of the base part 12 and the rear surface 12R thereof is set larger than the vertical thickness Ta of the arm part 13. Therefore, the moment of inertia of the section of a rectangular area of the base part 12, not including the rib-shaped portion 16B of the base part 12, is greater than the moment of inertia of the section of the arm part 13 not having the groove 18 formed thereon. Further, the moment of inertia of the section of the base part 12 is greater because the rib-shaped portion 16B is projected from the bottom surface 16A of the groove 16. The moment of inertia of the section of the arm part 13 is smaller because the groove 18 is formed thereon. As such, the moment of inertia of the section of the base part 12 is greater than that of the arm part 13, and, thus, the base part 12 has a higher flexure rigidity.

The thickness Tk of the base part 12, measured from the rear surface 12R to the bottom 16A of the groove 16, and not including the rib-shaped portion 16B, is substantially equal to the vertical thickness Ta of the arm part 13. Thus, sections of the base part 12 not having the rib-shaped portion 16B formed thereon and the arm part 13 not having the groove 18 formed thereon are equal to each other in the moment of inertia of the section. However, the rib-shaped portion 16B is formed on the base part 12, and the groove 18 is formed on the arm part 13. Therefore, the moment of inertia of the section of the base part 12 is greater than that of the arm part 13.

As described above, in the first embodiment, the base part 12 is less flexible than the arm part 13. Therefore, when the locking arm 11 tilts upward, namely, in a direction away from the connector housing 10, with an electric wire caught by the front end of the arm part 13, the arm part 13 deforms such that it curves with the inner surface 13B being substantially convex. Thus, the force acting on the front end of the locking arm 11 to displace the locking arm 11 away from the connector housing 10 is relaxed and as a result, not applied to the base part 12. The rigidity of the base part 12 is increased by the rib-shaped portion 16B. Consequently, the base part 12 is hardly strained. Accordingly, breakage of the base part 12 of the locking arm 11 is prevented.

There is a fear that the stress is increasingly applied to the arm part 13 because the arm part 13 is more flexible than the base part 12. However, because the arm part 13 is long in the front-to-back direction of the connector housing 10, the stress is dispersed in a wide range of the arm part 13. Accordingly, the stress is not locally applied to the arm part 13 and there is no possibility that the arm part 13 is broken.

Further, when a tensile load is applied to the rib-shaped portion during the upward tilting of the locking arm 11, the outer surface of the rib-shaped portion is liable to crack and break. But according to the first embodiment, the rib-shaped portion 16B is formed on the front surface 12F to which a compression load is applied. Thus, there is no fear that the locking arm 11 is cracked and thus broken.

Further, the thickness Tk of the base part 12 is larger than the thickeness Ta of the arm part 13. Thus, the rigidity of the base part 12 is increased and thereby the base part 12 is allowed to have a higher breakage prevention function.

Further, the rear surface 12R of the base part 12 continuous with the inner surface 13B of the arm part 13 and the outer surface 10A of the connector housing 10 is formed as a cylindrically generated arc-shaped surface. Thus, the rear surface 12R of the base part 12 has a larger radius of curvature than that of a surface formed in combination of a curved surface and a flat surface. Consequently, it is possible to prevent the stress from concentrating on the rear surface 12R of the base part 12 and to prevent breakage of the base part 12 to a high extent.

Figure 6:
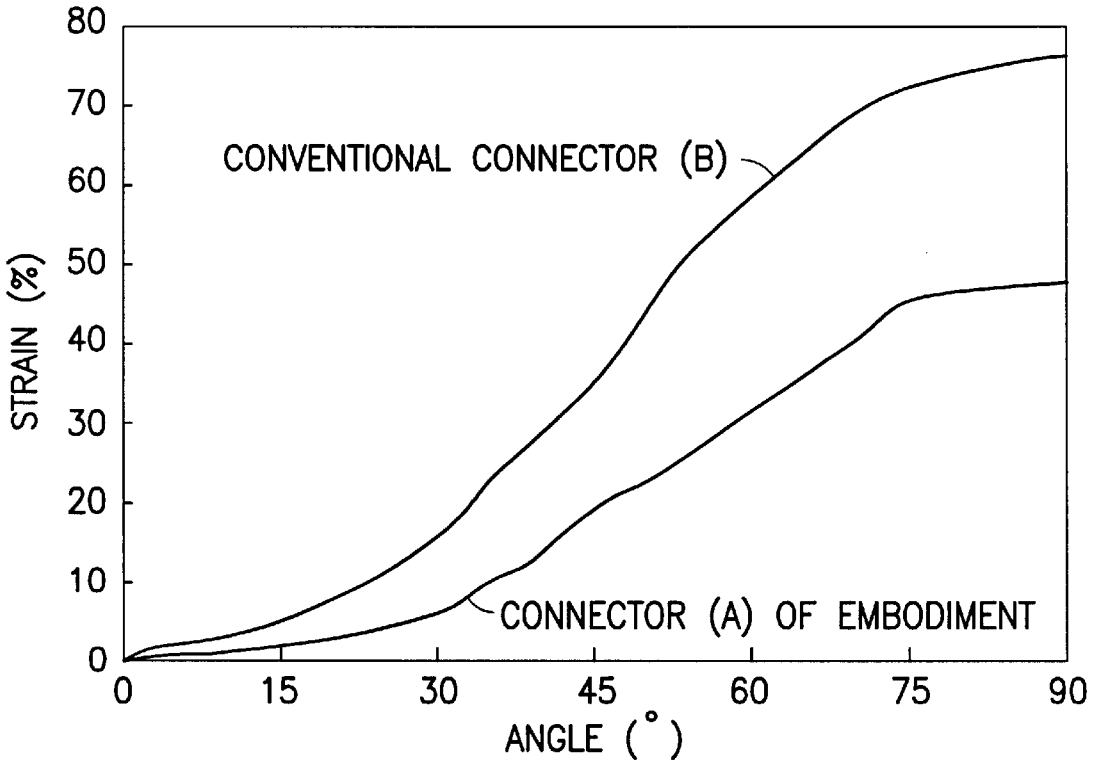
FIG. 6 is a graph showing the relationship between an angle of tilting made by an arm part with a base part acting as a supporting point and a maximum strain of a locking arm.

FIG. 6 shows a graph indicating the result of tests conducted on the connector housing A, made of PBT, of the first embodiment and a conventional connector B (shown in FIG. 5) made of PBT. The tests were conducted on the preferred connector A to investigate the correlation between the angle of tilting made by the arm part 13, with the base part 12 acting as the supporting point of the tilting motion of the arm part 13 and the maximum strain of the locking arm 11. Additionally the tests were conducted on the prior art connector B to investigate the correlation between the angle of tilting made by an arm part 23, with a base part 22 acting as the supporting point of tilting made by the arm part 23 and the maximum strain of a locking arm 21. In the conventional connector B, the thickness of the base part 22 was almost equal to that of the arm part 23. Further, a groove was not formed on the base part 22 and the arm part 23. The graph indicates that supposing that the tilting angle of the arm part 12 is equal to that of the arm part 23, the maximum strain value of the connector A of the first embodiment is smaller than that of the conventional connector B. This means that the locking arm 11 of the connector A of the first embodiment has a stress dispersion degree higher than that of the locking arm 21 of the conventional connector B.

The present invention is not limited to the embodiment explained by way of the above description and drawings. For example, the following embodiments are included in the technical scope of the present invention. Further, various modifications can be made without departing from the spirit and scope of the present invention.

In the preferred embodiment, the depth of the shallowest portion of the groove of the base part and that of the groove of the arm part are about ½ of the thickness of the base part and the arm part. But according to the present invention, the relationship between the depth of the groove and the thickness of the base part and the arm part can be set and altered as desired.

In the preferred embodiment, the depth of the shallowest portion of the groove of the base part is set equally to that of the groove of the arm part. But according to the present invention, both depths may be different from each other.

In the preferred embodiment, the curve constituting the sectional configuration of the groove as viewed along a section taken longitudinally along the locking arm is a circular curve having a uniform curvature (uniform diameter). But according to the present invention, the sectional configuration of the groove may comprise a curve whose curvature varies.

In the preferred embodiment, the sectional configuration of the groove as viewed along a section taken across the width of the base part includes a straight line. But according to the present invention, the sectional configuration of the groove may comprise a curve whose curvature is uniform or varies.

What is claimed is:

1. A connector having a connector housing with a front end, a rear end and an outer surface extending between the ends, a locking arm formed integrally with the outer surface of said connector housing, said locking arm including a base part erected from a location on said outer surface of said connector housing in proximity to said front end, said base part having a front face and an opposed rear face, an arm part cantilevered rearwardly from said base part and extending, in an unbiased condition, almost parallel with said outer surface of said connector housing such that a flexure space is defined between said outer surface of said connector housing and said arm part to enable said arm part to flex from said unbiased condition toward said outer surface when said connector and a mating connector are being locked to each other, said arm part further being deflectable from said unbiased condition away from said outer surface, wherein a groove is formed on said front face of said base part and on a face of said arm part facing away from said outer surface such that said groove formed on said base part extends along a direction in which said base part is erected and said groove formed on the arm part extends along a direction in which said arm part is extended; and a thickness between a bottom surface of the groove of said base part and the rear face thereof is approximately equal to or larger than a thickness of said arm part.

2. A connector according to claim 1, wherein said groove on said base part and said groove on said arm part are of substantially identical cross-sectional configurations.

3. A connector according to claim 1, wherein said groove on said base part and said groove on said arm part both are of substantially rectangular cross-sectional configuration.

4. A connector according to claim 1, wherein the thickness between the bottom surface of said groove of said base part and the rear face thereof is approximately 1.5 times the thickness of said arm part at locations on said arm part spaced laterally from said groove therein.

5. A connector according to claim 1, wherein said arm part has a projection formed thereon for locked connection with the mating connector, said groove on said arm part being disposed between said projection and the base part.

6. A connector according to claim 1, wherein the groove extends continuously from the base part to the arm part.

7. A connector according to claim 1, wherein the rear face of said base part is continuous with an inner surface of said arm part and with said outer surface of said connector housing and defines a substantially cylindrical arc-shaped surface.

8. A connector according to claim 7, wherein the substantially cylindrical arcshaped circular surface at said rear face of said base part is substantially tangent to the outer surface of said connector housing and substantially tangent to said inner surface of said arm part.

9. A connector having a connector housing with a front end and an opposed rear end, an outer surface extending between the front and rear ends of the connector housing, a locking arm extending from the outer surface of the connector housing, the locking arm comprising a base part directed away from said outer surface adjacent the front end of the connector housing, a deflectable arm part cantilevered from said base part and extending rearwardly such that, in an unbiased condition, said arm part is in spaced relationship to the outer surface of the connector housing, said arm part being deflectable from said unbiased condition toward and away from said outer surface, the base part of said locking arm including a front surface substantially aligned with the front end of the connector housing, the arm part including an upper surface facing away from the outer surface of the connector housing, a groove being formed in said front surface of said base part and continuing into at least a portion of said upper surface of said arm part such that the groove formed on the base part extends along a direction in which the base part is erected and the groove formed on the arm part extends along a direction in which the arm part is extended.

10. A connector according to claim 9, wherein said upper surface of said arm part includes a locking projection at a location thereon spaced rearwardly from said base part, the groove in the upper surface of the arm part extending continuously from said locking projection to the front surface of the base part.

11. A connector according to claim 10, wherein a portion of said groove defines a continuous curved surface extending from the portion of the groove on the base part to the portion of the groove on the arm part.

12. A connector according to claim 9, wherein the base part includes a rear surface that defines a concave surface substantially cylindrically generated, said cylindrically generated concave surface extending continuously into said outer surface of said connector housing and into an inner surface of said arm part.

13. A connector according to claim 9, wherein the base part defines a base thickness measured from a bottom surface of said groove in said base part to a rearwardly facing surface of said base part, and wherein the arm part defines an arm thickness at locations thereon spaced laterally from the groove in said arm par, the base thickness being at least equal to the arm thickness on the arm part.

14. A connector according to claim 13, wherein the base thickness is approximately 1.5 times the arm thickness.

15. A connector according to claim 13, wherein the groove is of substantially uniform cross-sectional size and shape at all locations thereon.

* * * * *